US005908137A

United States Patent [19]

Pattarozzi

[11] Patent Number: 5,908,137

[45] Date of Patent: Jun. 1, 1999

[54] DISPENSER FOR SUPPLYING PIECES OF PAPER

[75] Inventor: Cristian Pattarozzi, Bazzano, Italy

[73] Assignee: 3P S.r.l., Bologna, Italy

[21] Appl. No.: 08/860,580

[22] PCT Filed: Jan. 3, 1996

[86] PCT No.: PCT/IB96/00001

§ 371 Date: Jun. 30, 1997

§ 102(e) Date: Jun. 30, 1997

[87] PCT Pub. No.: WO96/20631

PCT Pub. Date: Jul. 11, 1996

[30] Foreign Application Priority Data

Jan. 4, 1995 [IT] Italy ..... BO95A0001

[51] Int. Cl.[6] ..... A47K 10/24

[52] U.S. Cl. ..... 221/45; 242/564.3

[58] Field of Search ..... 221/45, 33, 49, 221/282; 242/564, 595, 564.3, 564.4; 312/34.1

[56] References Cited

U.S. PATENT DOCUMENTS

| | | | |
|---|---|---|---|
| 3,167,368 | 1/1965 | Rozlog et al. | 312/39 |
| 3,301,617 | 1/1967 | Goodwin et al. | 312/39 |
| 3,737,087 | 6/1973 | Rooklyn | 226/110 |

FOREIGN PATENT DOCUMENTS

| | | |
|---|---|---|
| 0 145 622 | 6/1985 | European Pat. Off. . |
| 0 192 591 | 8/1986 | European Pat. Off. . |
| 0 483 749 | 5/1992 | European Pat. Off. . |
| 2 205 186 | 8/1973 | Germany . |

*Primary Examiner*—Kenneth Noland
*Attorney, Agent, or Firm*—Nims, Howes, Collison, Hansen & Lackert

[57] ABSTRACT

The dispenser supplies pieces of paper, pulled out from a reel of paper (2) contained therein, without any contact between a user and not pulled out paper. If the paper reel has transversal pre-cut lines, the length of each piece is equal to one or more distances between the two following pre-cut lines. If the paper reel has not transversal pre-cut lines, the length of each piece is determined by the user.

13 Claims, 9 Drawing Sheets

5
81
82a
50
W
30
63
2
96
96a
91
95
64
93
35
51
0
A 1
3
82
81
W
5
80
82b
82a
50
XIV
82c
F
6
62
2
61
9
R
XIV
92

DISPENSER FOR SUPPLYING PIECES OF PAPER

TECHNICAL FIELD

The present invention relates to small electrical household appliances, capable of facilitating some operations usually performed manually or by manually operated devices.

BACKGROUND ART

The use of electrical household appliances sometimes has positive effects in particular fields, such as hygiene, very important specially in public areas, places of work, communities and the like, particularly when food and hygienic services are concerned.

In such places there are usually used reels of paper, from which one takes pieces of paper of different length, according to the needs.

At present, these reels of paper are inserted in very simple devices; the user manually unwinds and tears a piece of paper he needs, using the pre-cut lines made in the reel of paper, or suitable blade with which the device is equipped.

The most common types of the above mentioned devices cannot avoid the contact between the user and the paper remaining on the reel, i.e. the paper that will be used by the next user.

This unacceptable situation causes the users' precautionary behaviour, what means that they take first a piece of paper to throw away and another piece of paper to be used.

This results in great waste of material and consequently, in high operating costs, due to frequent interventions of supplying staff.

DISCLOSURE OF THE INVENTION

The object of the present invention is to propose a dispenser of pieces of paper, constructed in such a way as to supply pieces of paper, pulled out from the reel of paper contained therein, of desired length or of length equal to one or more predetermined value, i.e. distance between two following transversal pre-cut lines made in the same reel of paper, the whole without any contact between the user and the not taken paper.

The object as defined before, is achieved by means of a device for supplying pieces of paper from a paper strip with or without transversal pre-cut lines, including a box-shaped housing with a recess for receiving a reel of paper, a first pulling-out mechanism with upper and lower rollers connected to each other by belts which run into grooves made in the rollers, the grooves of the upper roller having innermost diameter bigger than the diameter of the lower rollers' grooves, a second pulling mechanism including a second pair of upper and lower rollers also connected to each other by belts which run into grooves, with the grooves of the upper roller having a diameter bigger than the diameter of the grooves of the lower roller and with a run of each one of these last mentioned belts facing a corresponding run of a previously mentioned belt of the first pulling-out mechanism, a cover hinged to the housing for insertion of a reel into the recess and adapted to assume one or the other of several positions, and power driving means activated by control means and provided for operating said pulling-out mechanisms.

According to a first embodiment, the cover can take two positions which correspond to a first situation in which the upper rollers are almost in contact which each other, whereas the lower rollers are separated from each other to define a condition in which a piece of paper is unrolled from the reel and made pass through said upper rollers, said facing runs of the belts, and said lower rollers, then going out of the dispenser, and to a second situation in which said upper and lower rollers are almost in contact with each other to define a condition in which the piece of paper is separated from the strip along one of said pre-cut lines located between the upper lower rollers as a consequence of pulling action due to higher speed of the lower rollers with respect to the upper rollers.

In a second embodiment there is provided a switch, subjected to elastic means placed between facing runs of the belts and set in engagement therewith, while the cover takes one or the other of two positions, namely an inoperative closing position (R) and an operative closing position (O), and a stationary blade is located in a position intermediate between the upper and lower rollers.

The belts also operate a switch connected to the power driving means so that first, the upper rollers are kept almost in contact with each other, whereas the lower rollers are separated from each other and a piece of paper is unrolled from the reel, and then the upper and lower rollers are kept almost in contact with each other and the pulling action provoked by higher speed of the lower rollers tightens the piece of paper and changes the arrangement of the facing runs connected to the switch, so that the piece of paper is cut by the stationary blade.

In a third embodiment, there is provided a pinion keyed to an head of the upper roller of the first pulling-out mechanism for mesh engagement with a toothed sector of a disc supported by the housing, and two auxiliary rollers supported by the upper roller of the second pulling-out mechanism, which are pressed onto sloping surfaces integral with the housing by the elastic reaction of the belts.

An annular cam groove is made in the disc and includes an in/out region, a first portion with constant radius, and a second portion with varying radius, along which a pin of the cover runs.

A blade is formed by adjacent sectors and supported by the housing between the upper and lower rollers while a paper pressing member is supported by the cover in a position in which it faces the blade.

In this case, first the cover takes a position, in which the paper unrolls from said reel, then the cover takes a further position, in which the paper unrolling stops and the paper located between said pulling-out mechanisms is pushed by the paper pressing element against the blade thus making a series of cuts in the paper, and lastly the cover takes another position, in which the upper and lower rollers touch each other and are operated to tear a piece of paper from the strip along the cuts.

BRIEF DESCRIPTION OF THE DRAWINGS

The characteristic features of the present invention, in accordance with claims, are pointed out in the following description with particular reference to the enclosed drawings, in which:

BEST MODES OF CARRYING OUT THE INVENTION

Figure 1A:
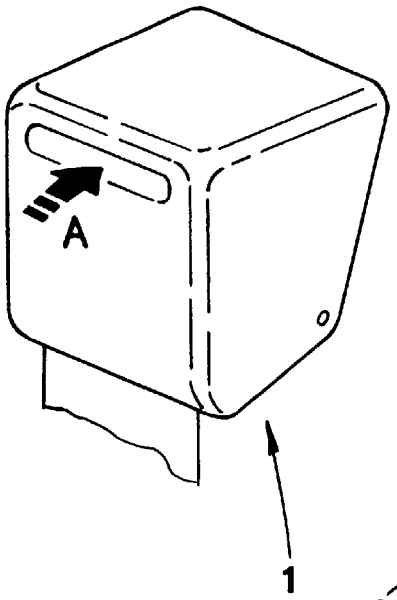
FIGS. 1*a*, 1*b*, 1*c* show as examples, some dispensers designed to contain different reels of paper of the most common types.

With reference to the above mentioned figures, the dispenser of paper pieces, being the subject of the present invention, is indicated with reference numeral 1.

Figure 1B:
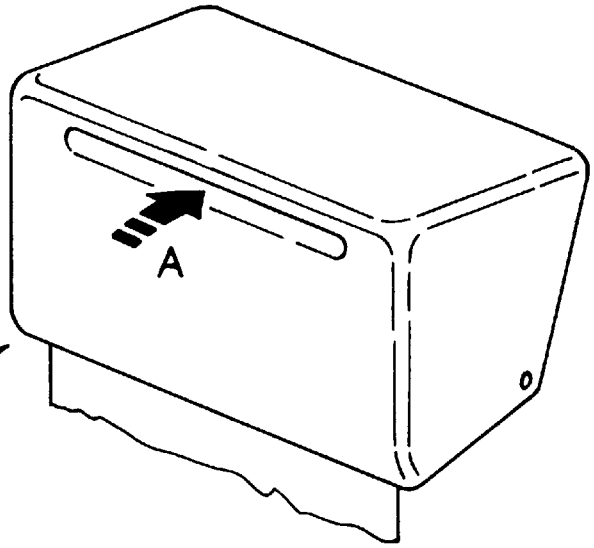
Figure 1C:
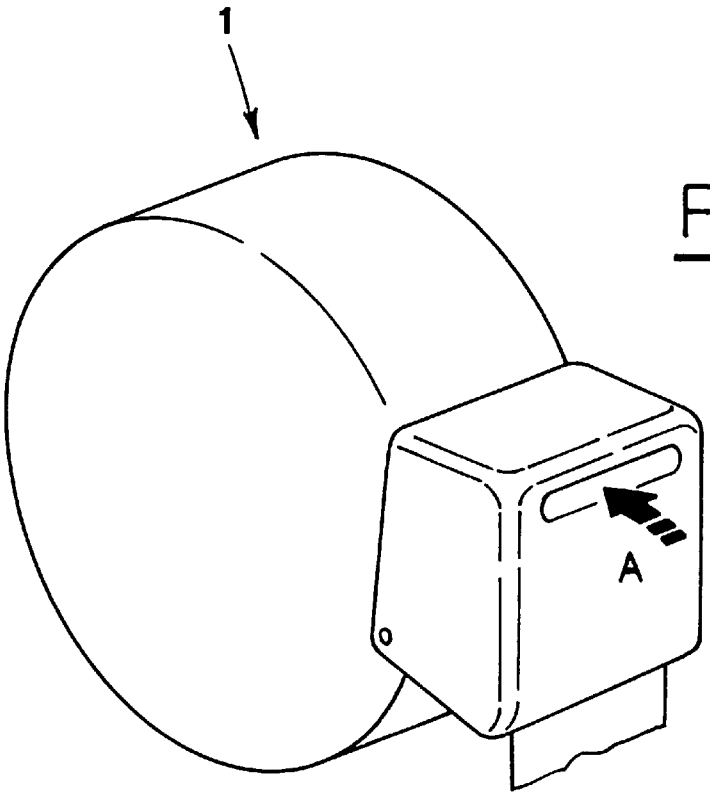

FIGS. 1*a*, 1*b*, 1*c* show the examples of different possible shapes of the dispenser 1, for toilet paper for domestic use, (FIG. 1*a*), for multipurpose paper reels (FIG. 1*b*) and toilet paper reels of great diameter for public places (FIG. 1*c*).

Figures from 2 to 6 show the dispenser 1, designed for delivering pieces of paper from reels 2 with transversal pre-cut lines (not shown), including a box-shaped housing 3, to be fixed to the wall, with a recess 4 for receiving a reel 2 of paper.

Figure 2:
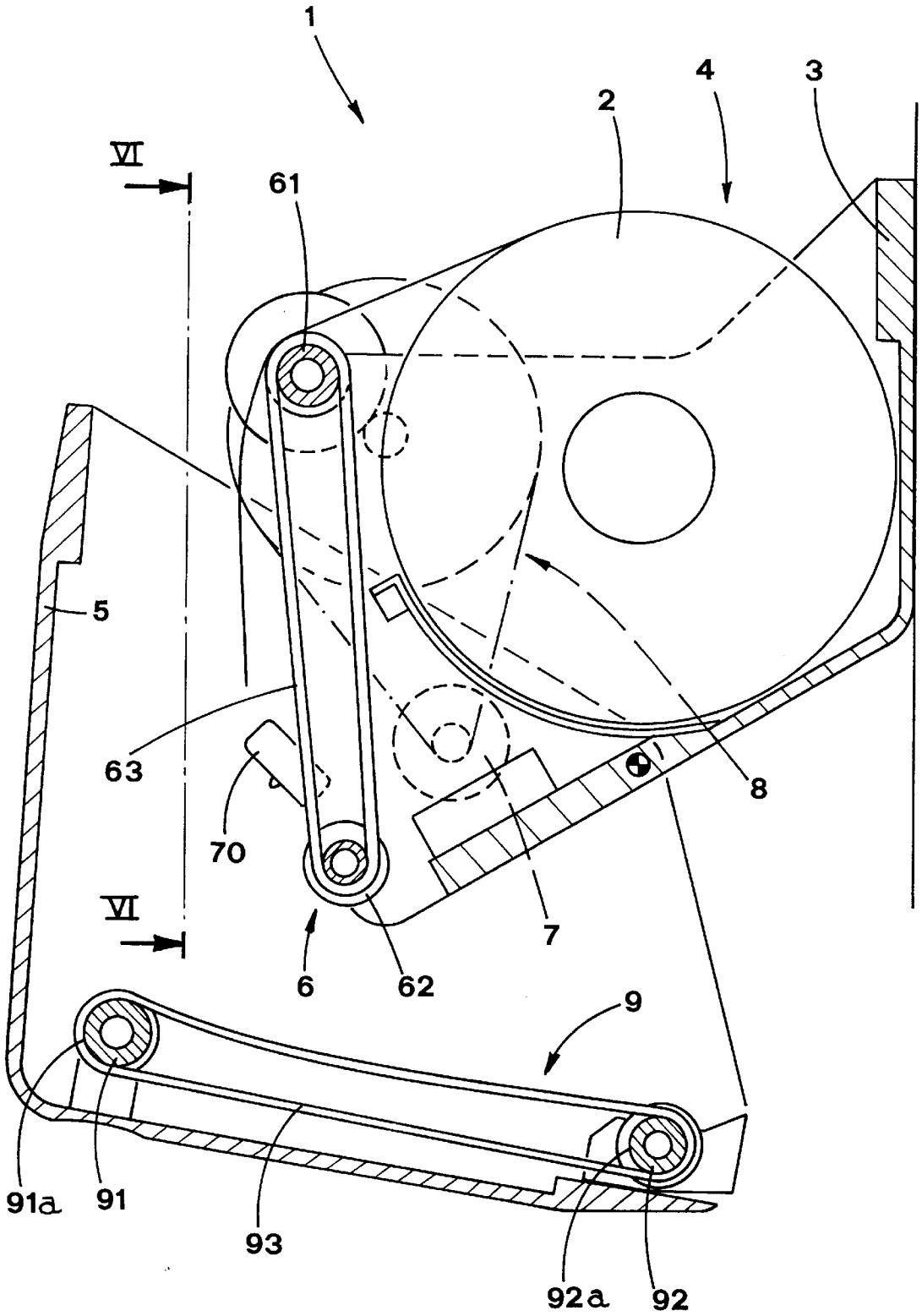
FIG. 2 shows a lateral sectional view of the dispenser opened in order to introduce the paper reel.

A cover 5 is hinged to the box-shaped housing 3 for allowing, when opened, insertion of a reel 2 into the recess 4 (FIG. 2).

A first pulling-out mechanism 6, supported by said box-shaped housing 3, includes a first pair of horizontal rollers 61, 62, upper and lower respectively, connected to each other by a plurality of belts 63 which run into respective first and second grooves 61*a*, 62*a* made in said upper and lower rollers 61, 62.

The box-shaped housing 3 supports also power driving means 7, which include e.g. an electric motor, connected to link member 8 that is joined, at the outlet, to the upper roller 61.

The innermost diameter of the grooves 61*a*, made in the upper roller 61, is bigger with respect to the diameter of the corresponding grooves 62*a* of the lower roller 62: it results in the bigger speed of the lower roller 62, driven to rotate by the belts 63, with respect to the upper roller.

A second pulling-out mechanism 9, similar to the first one, supported by the cover 5, includes a pair of horizontal rollers 91, 92, upper and lower respectively, connected to each other by a plurality of belts 93 which run into respective first and second grooves 91*a*, 92*a*, made in the same rollers 91, 92.

Likewise the first mechanism 6, also the innermost diameters of the grooves 91*a*, 92*a* are different so that the speed of the lower roller is bigger than the speed of the upper roller, when they are driven to rotate.

It is to be pointed out that the illustrated embodiment makes the pulling-out mechanisms 6, 9 keep the cover 5 close with respect to the housing 3: more precisely, the upper rollers 61, 91 and lower rollers 62, 92 and the fulcrum F between the cover 5 and the housing 3 are positioned one with respect to another in such a manner that, during the closing action, the upper roller 91 and the lower roller 92 of the second pulling-out mechanism 9 slip over the upper roller 61 and the lower roller 62 of the first pulling-out mechanism 6, respectively, and, after having passed an unstable situation, they assume, with pressure thereon, a stable position, where the cover is locked.

Figure 3:
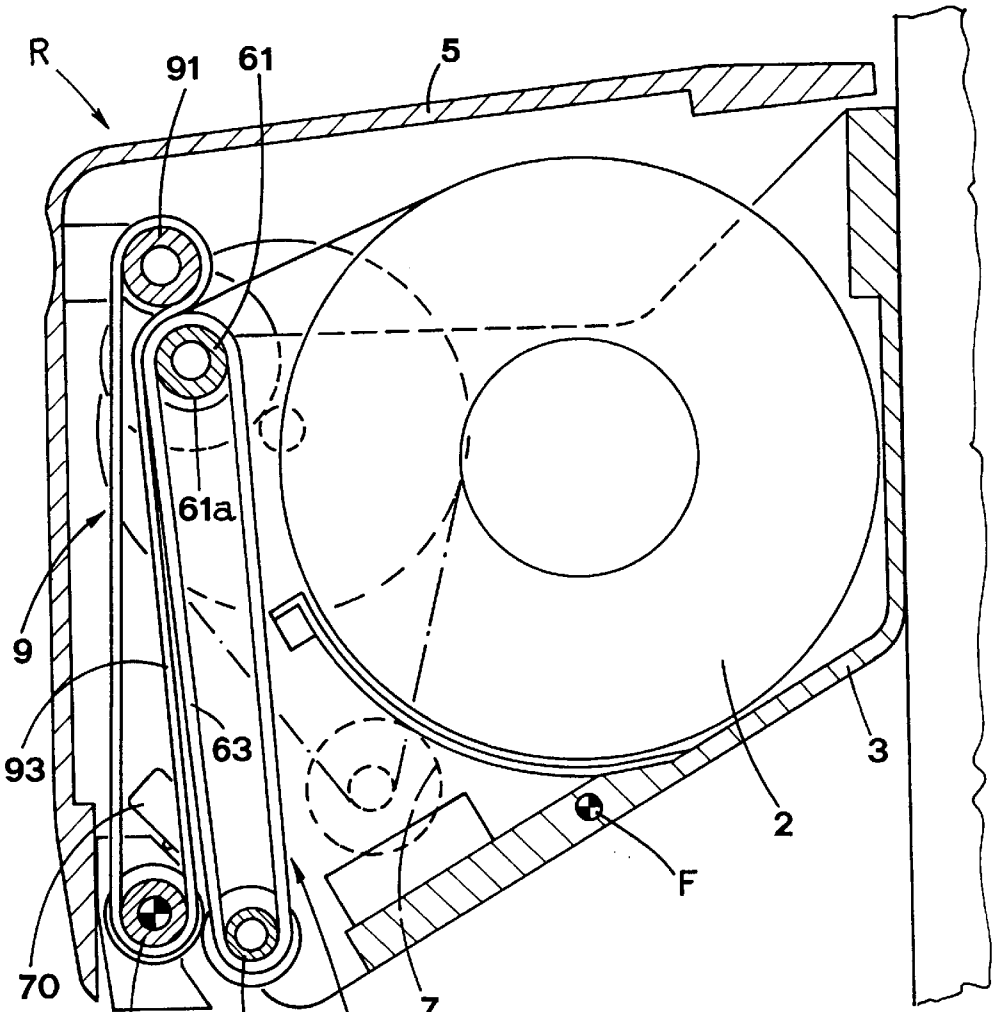
FIG. 3 shows the dispenser when it is closed and in inoperative conditions.
Figure 5:
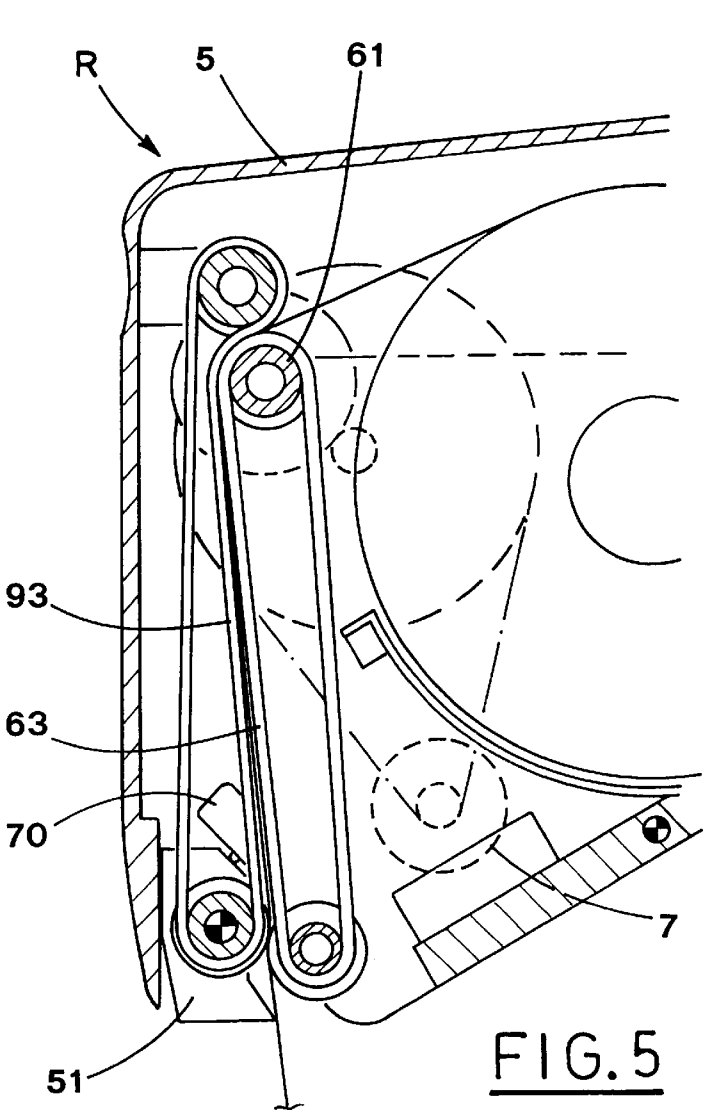

The rollers 91, 92 can be released from this last locking position only by counterclockwise pressure (FIG. 3). Push button means 70, supported by the box-shaped housing 3, include e.g. a micro switch that activates the power driving means 7.

A rocker lever 51, supported by the cover 5, situated in the region of the push button means 70 to act thereon as described in the following. The dispenser inoperative position, shown in FIG. 3, in which the upper rollers 61, 91 and the lower rollers 62, 92 touch each other (i.e. cover closing and inoperative position R), is followed by a first operative position (FIG. 4), due to a pressure exerted manually on the cover 5 in the direction indicated with the arrow A (closing and operative position O of the said cover).

This causes the micro switch 70 being operated by the lever 51, and consequently, activation of the power driving means 7 of the first pulling-out mechanism 6 connected thereto, and of the second pulling-out mechanism 9 driven by friction of the first pulling-out mechanism 6.

Moreover, the rotation of the cover 5 make the lower rollers 62, 92 of the pulling-out mechanisms 6, 9 separate one from the other, while the upper rollers 61, 91 are still almost in contact.

Figure 4:
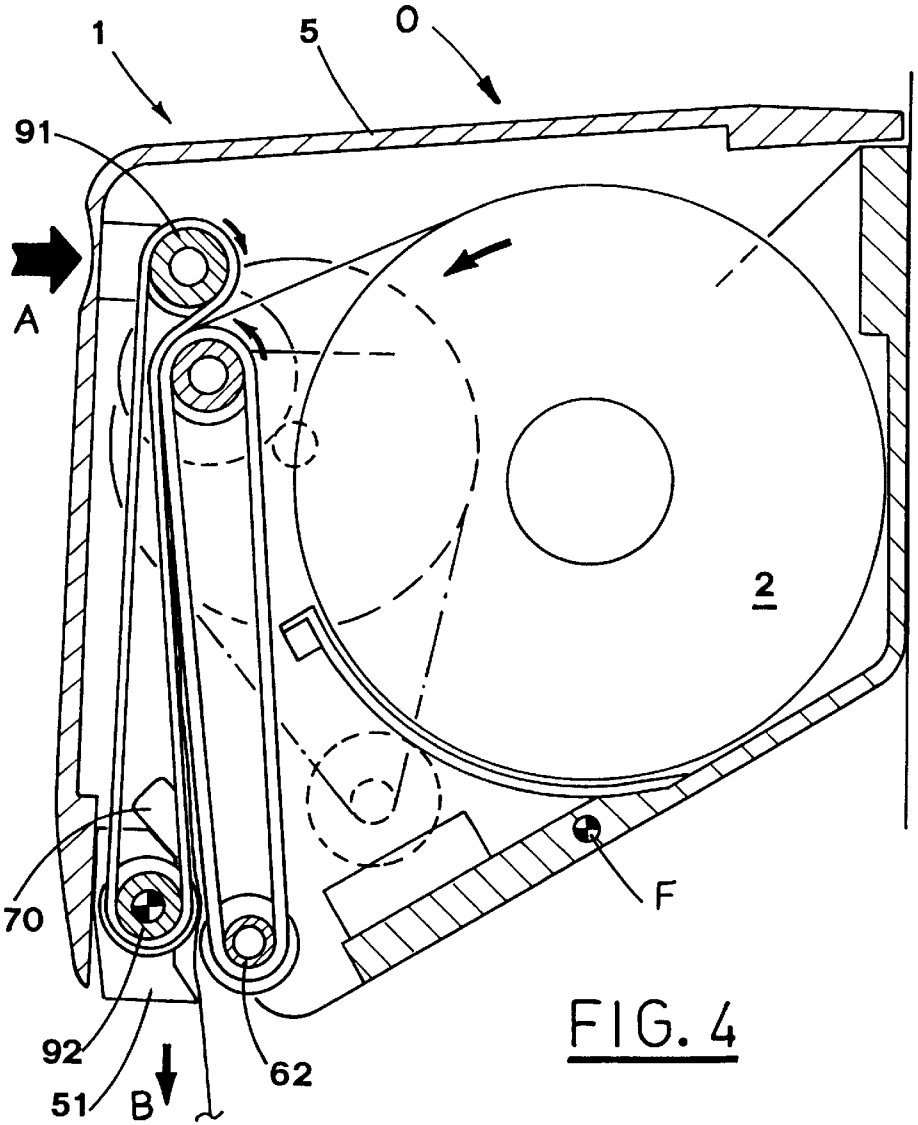
Figure 6:
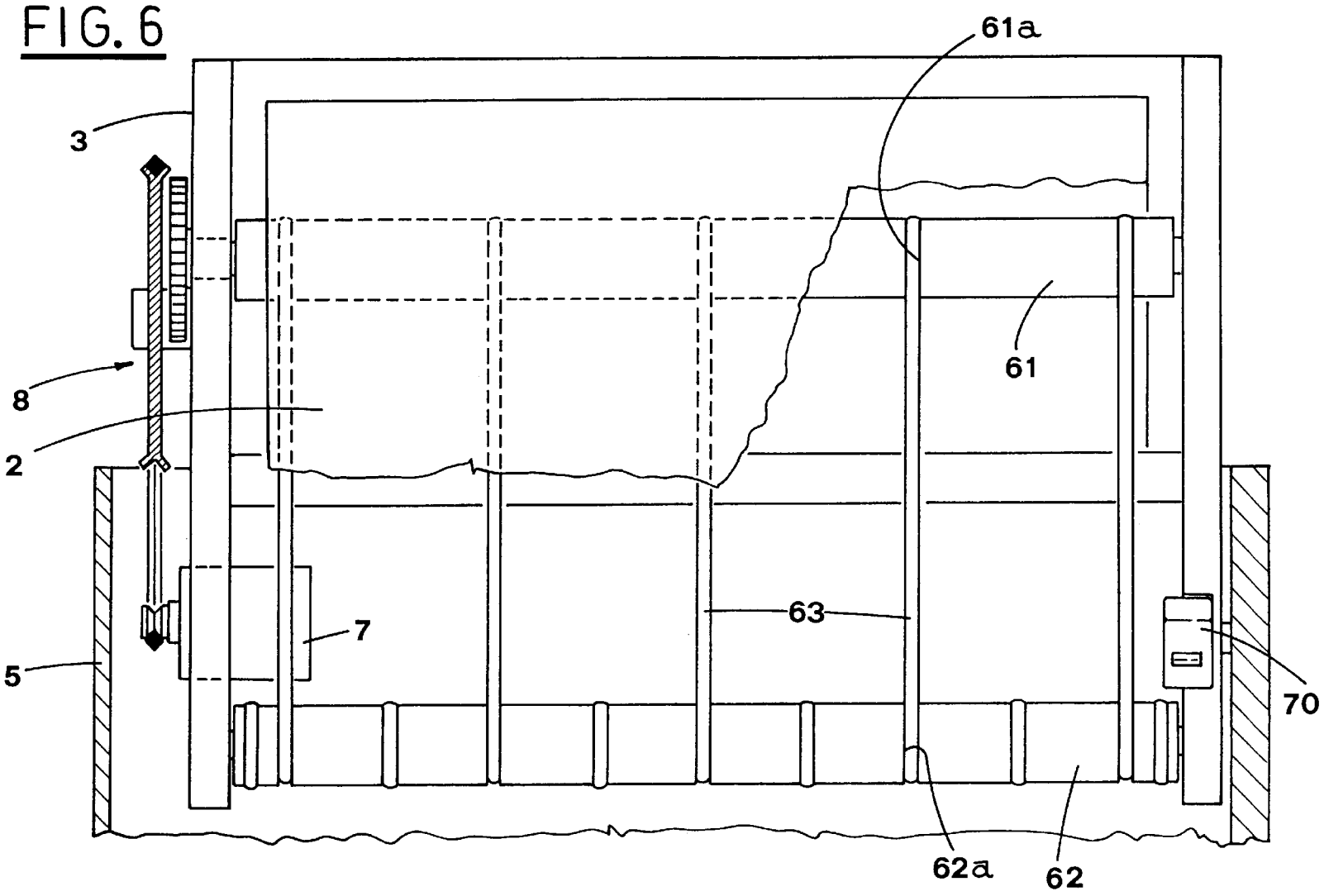
FIG. 6 shows a front, partially sectioned view of the dispenser taken along the plane VI—VI of FIG. 2.

In this condition, the paper is unwound from the reel 2 by the upper rollers 61, 91 and, guided by the belts 63, 93 goes out of the lower part of the dispenser 1, downstream of the pulling-out mechanisms 6, 9 and next to the rocker lever 51, in the direction indicated by the arrow B (FIG. 4).

When a piece of paper of desired length has been delivered, the pressure on the cover 5 is removed and the cover returns to the initial inoperative position R. Consequently, the power driving means 7 stop, as a result of deactivation of the micro switch 70.

In the second operative step, the piece of paper going out of the dispenser 1 is held with the hand and slightly pulled in diagonal direction, as indicated by the arrow C (FIG. 5*a*), so as to make the lever 51 swing toward the micro switch 70 and activate it, thus driving the pulling-out mechanisms 6, 9 again to rotate.

In this condition, the paper is held simultaneously between the upper rollers 61, 91 and between the lower rollers 62, 92. Because of the higher speed of the lower rollers 62, 92, the piece of paper comprised between the same rollers is pulled, and is separated from the remaining paper, along the pre-cut line made therein.

When the piece of paper has left the dispenser 1, the pressure on the lever 51 is decreased and the micro switch released, so that the power driving means 7 are deactivated and, in this way, the pulling-out mechanisms 6, 9 stop.

Figure 5A:
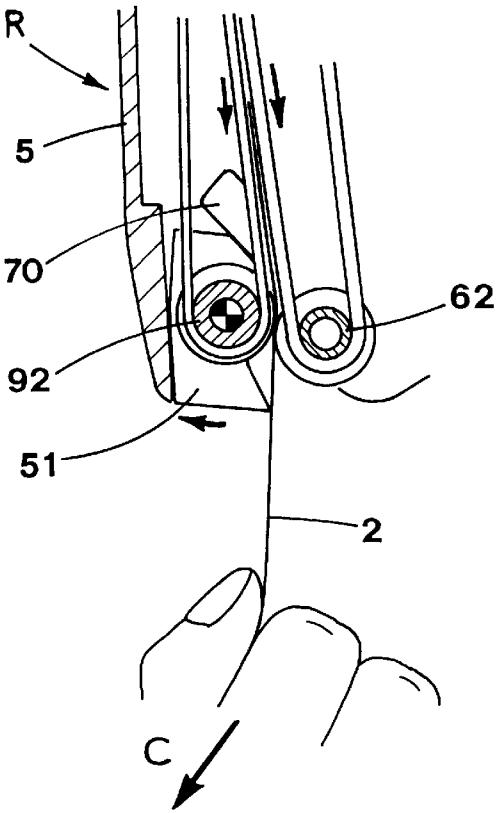
FIGS. 4, 5, 5*a* show subsequent working steps for withdrawing a piece of paper with pre-cut lines made therein.
Figure 9:
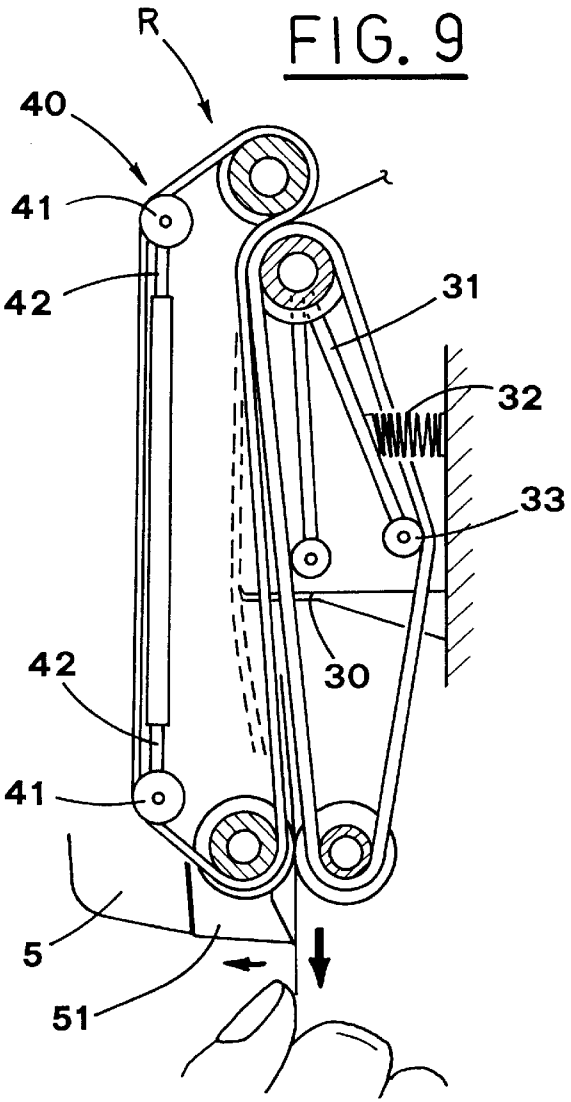
FIGS. 7, 8, 9 show subsequent operation steps of a first embodiment for using paper reels without pre-cut lines.
Figure 8:
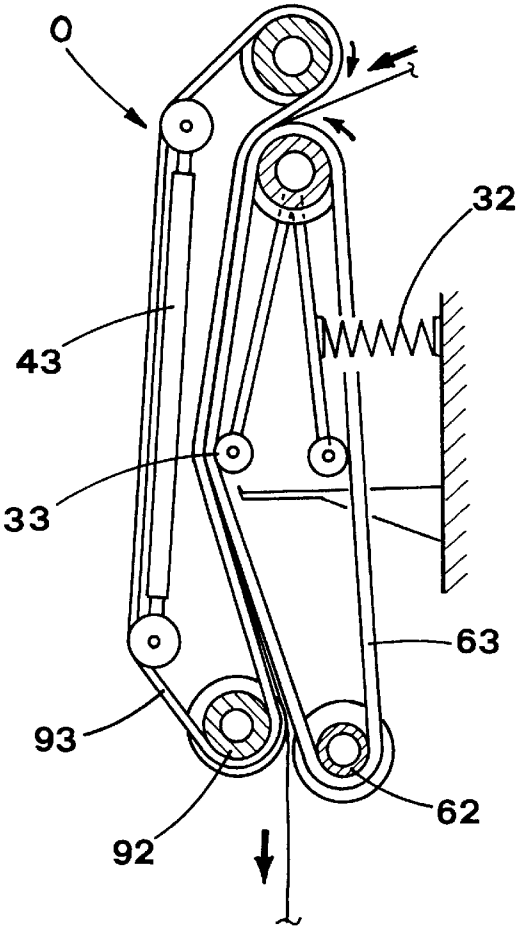
Figure 7:
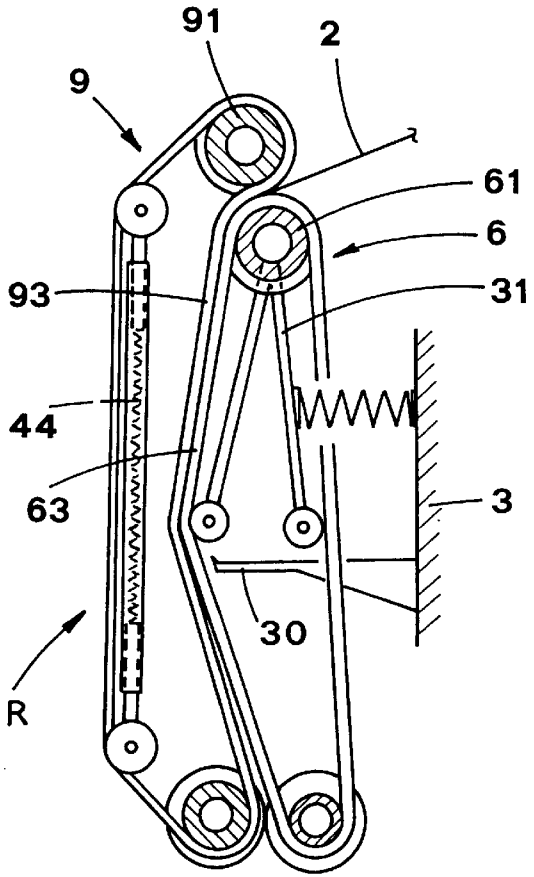
Figure 11:
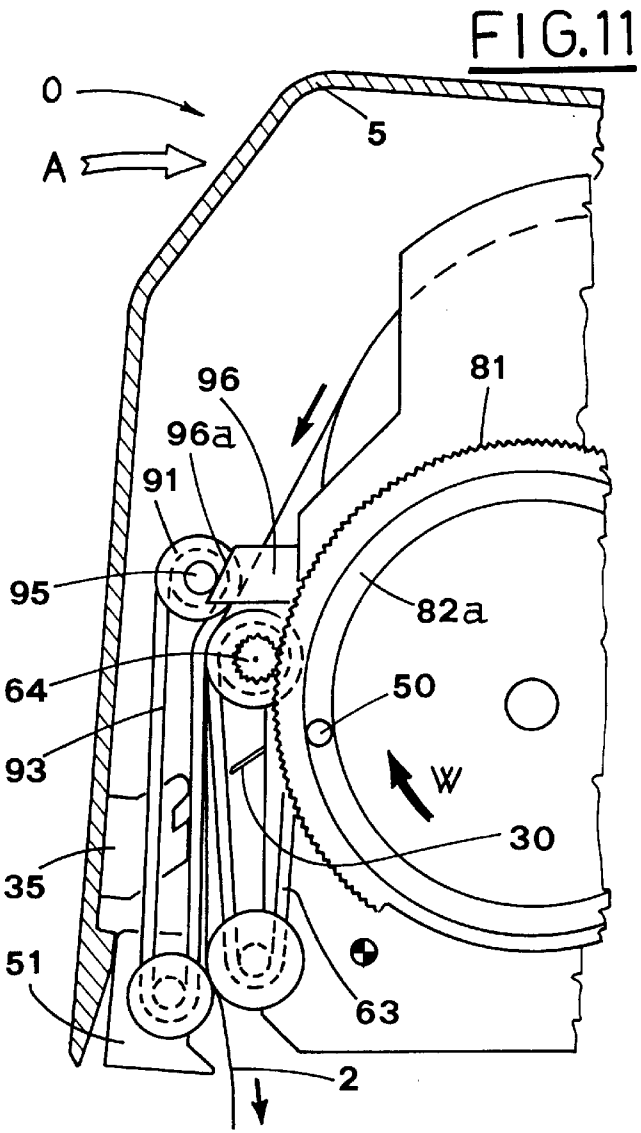
FIGS. 10, 11, 12, 13 show subsequent operation steps of a second embodiment for using paper reels without pre-cut lines.

FIGS. 7, 8, 9 show working steps, correspondent to the FIGS. 3, 4, 5*a*, of another constructive variant of the pulling-out groups 6, 9, arranged to use reels of paper without pre-cut lines.

For the simplicity's sake, FIGS. 7, 8, 9 do not show in detail the elements surrounding the pulling-out mechanisms, since they are not substantially or functionally changed with respect to what has been previously illustrated and described.

In the above mentioned modified form, a stationary blade 30 is secured to the box-shaped housing 3 in an intermediate position between the upper rollers 61, 91 and the lower rollers 62, 92.

The fulcrum of a fork operated switch 31, subjected to elastic means 32, is situated on the same rotation axis of the roller 61.

Rollers 33, supported rotatably by the ends of the prongs of the fork 31, touch the facing runs of the belts 63 of the first pulling-out mechanism 6. The second pulling-out mechanism 9 features a belt tightener 40; in the shown example, the tightener includes a pair of rollers 41, engaged with the belts 93, and carried rotatably by the ends of bars 42, which are inserted telescopically, on the opposite parts, into a sleeve 43, against the reaction of elastic means 44, located inside the sleeve 43.

The belt tightener 40 is designed to maintain the correct tension of the belts 93 during the working steps described below.

Advantageously, suitable elastic belts 93 can be used instead of the belt tightener 40. In the inoperative position of the dispenser 1, with the cover 5 closed, the rollers 61, 91 and 62, 92 of the mechanisms 6, 9 are almost in contact, while the switch 31, due to the action of the elastic means 32, keeps the belts 63, 93, along the section, in which they are mutually opposite pressing each other and oriented in such a manner that the defined path of the paper between the belts 63, 93 does not interfere with the fixed blade 30 (FIG. 7).

The above mentioned situation is maintained also during the paper unwinding step (FIG. 8), with lower rollers 62, 92 separated, completely identical with the correspondent step of FIG. 4.

When the piece of paper of desired length has been delivered, the pressure on the cover has been removed and the power driving means 7 stopped, the second step follows, in which the piece of paper is held with a hand in order to reactivate the power driving means 7 by the rocker lever 51.

The portion of paper comprised between the rollers 62, 92 is pulled due to the higher speed of the same lower rollers 62, 92, as has been already described.

The above mentioned pulling action determines the movement of the fork operated switch 31 against the elastic means 32 (FIG. 9); consequently, the paper follows such a path, defined by the belts, that it is struck by the stationary blade 30 and cut off.

When the piece of paper has left the dispenser, the power driving means 7 stop in the same way as has been previously described.

Figure 10:
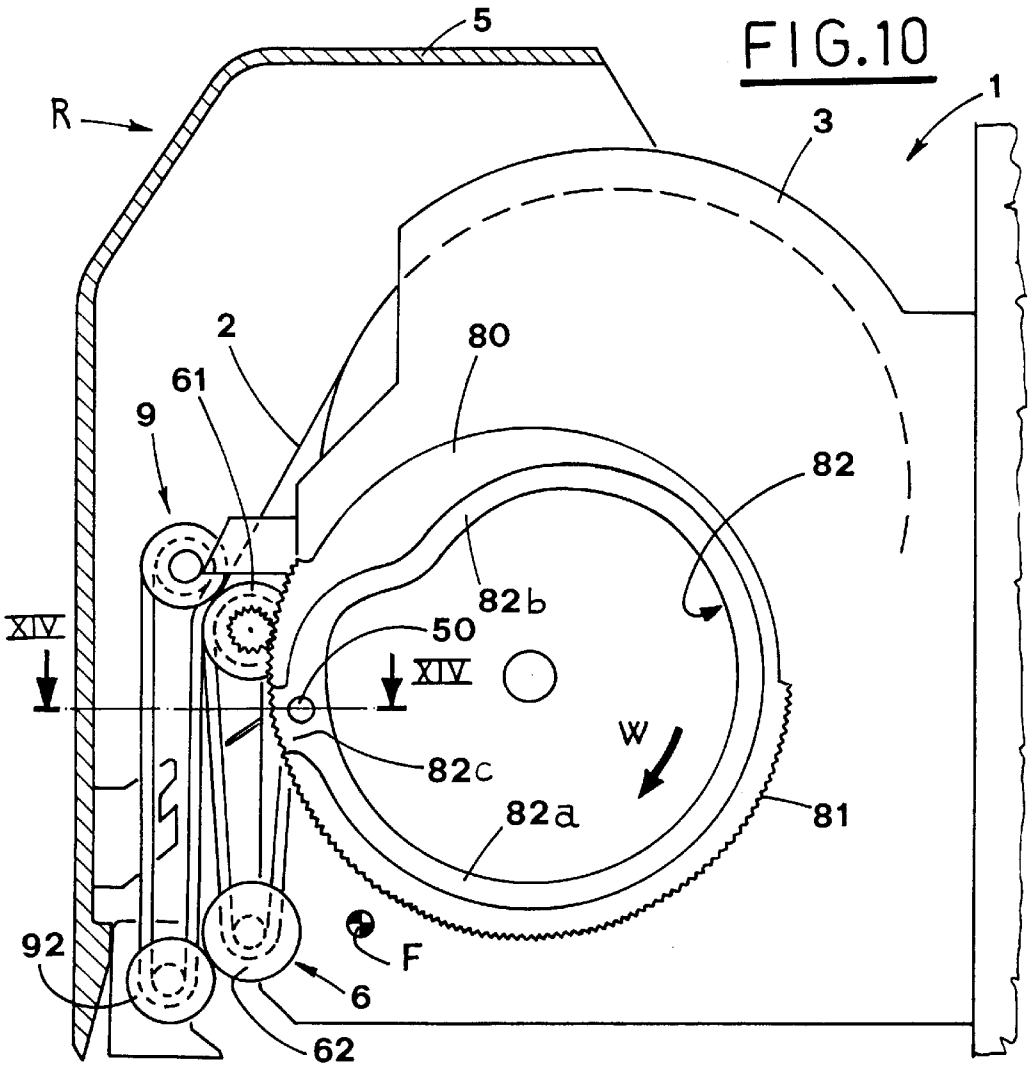

In FIG. 10 and the following ones, there is shown a further embodiment that is in particular designed for reels of paper without pre-cut lines and rather thick, e.g. the type used as hand dryer.

In this instance, reaction force of the paper firstly due to the cut action and then to tear action, get rather high value that could provoke failure in operation of the device, when the previously described embodiment is adopted.

In the same way as in previously described embodiment, when a first pulling-out mechanism 6 and a second pulling-out mechanism 9 are operated, the lower rollers 62, 92 rotate faster than the upper rollers 61, 91.

A pinion 64 is keyed to a head of the upper roller 61 and is in meshing engagement with a toothed sector 81 that is made along the outline of a disc 80 rotatably supported by the housing 3 and connected to the power means 7 by link means which are not shown.

One of the disc sides, the one that faces the cover 5, features a cam groove 82 in which a pin 50, rotatably fixed to the cover 5, runs. The path of the cam groove 82 extends in direction W, according to which the disc rotates, so as to define two adjacent portions 82*a*, 82*b* which correspond to unrolling of the paper 2 from the reel and subsequent cutting thereof as described in the following.

At the end of the portion 82*b*, i.e. at the beginning of the portion 82*a*, there is made an in/out region 82*c*, open in the outer side of the disc 80 for disengagement of the pin 50 when the cover is opened.

The upper roller 91 supports at both ends two auxiliary idling rollers 95 which are in abutment on sloping surfaces 96*a* due to the elastic action of the belts 93. The sloping surfaces 96*a* are formed on extensions 96 made integral with the housing 3.

A blade 30, formed by adjacent sectors, is secured to the housing 3, in a position intermediate between the upper and lower rollers of the pulling-out mechanisms 6, 9 with a paper pressing member 35, secured to the cover and facing the blade.

In FIG. 10, there is shown the closing and inoperative position R of the cover 5 in accordance with the modified form of the subject dispenser.

Unlike the previously described constructive forms, this position is set by known means, which are not shown, which allow the cover 5 to take the operative positions as described in the following.

In the same FIG. 10, it is possible to see the upper rollers 61,91, and respectively the lower rollers 62,92, which touch each other while the disc 80 is in the idle position, in which the beginning of the toothed sector 81 is in mesh with the pinion 64, and while the in/out region 82*c* is in the area of the pin 50.

When a pressure is applied by hand to the cover 5, in direction indicated by arrow A (operating position O of the cover), the pin is shifted to be in alignment with the inlet of the cam groove 82 and the micro switch 70 (not shown in this Figure) is operated by the lever 51.

This causes activation of the power driving means, which rotate the toothed sector 81 in direction W, that, due to its meshing with the pinion 64, drives the pulling-out mechanisms 6,9 for pulling a piece of paper from the paper reel 2.

While this action is being performed, the pin 50 runs the first portion 82*a* of the cam groove 82 that extends along a constant radius arc concentric with the disc 80.

It is to be noted that during unrolling of the paper, the lower rollers 62,92 always touch each other, while the auxiliary rollers 95 run along the respective sloping surfaces 96*a* and move the upper roller 91, connected to them, apart from the other upper roller 61.

This allows to constantly pull the paper that passes through the pulling-out mechanisms 6,9 because of the higher rotation speed of the lower rollers with respect of the upper rollers. The paper can slip between the belts 63,93 in the region of the upper rollers, which are, as already mentioned, kept apart from each other.

Duration of this unrolling action, and consequently the length of the piece of paper being delivered, depends on the length of the toothed sector 81.

Then, due to rotation of the disc 80, the toothed sector 81 disengages from the pinion 64, and both the pulling-out mechanisms 6,9 stop so that the paper is no longer unrolled.

Meanwhile, the pin has reached the end of the first portion 82*a* of the cam groove 82. Continuation of rotation of the disc 80 brings the pin 50 to run the second portion 82*b* of the cam groove 82, which includes a section with progressively decreasing radius, as illustrated in FIG. 12.

Figure 12:
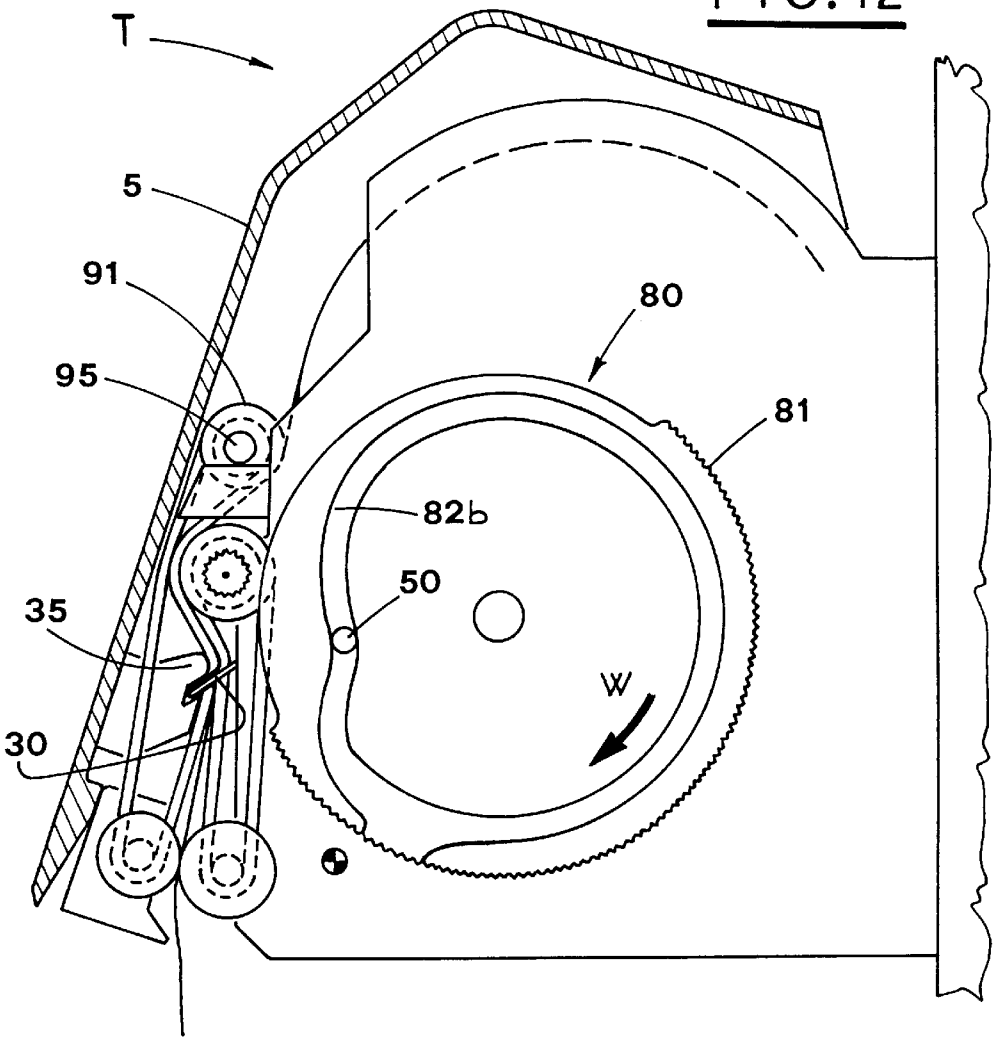

Because of this radius decrease, the cover 5 is imparted a further rotation in direction A that brings it to the cutting position T, wherein the paper pressing member 35 pushes the paper against the blade 30 in the region between the pulling-out mechanisms 6,9 (see FIG. 12).

Figures 14, 15:
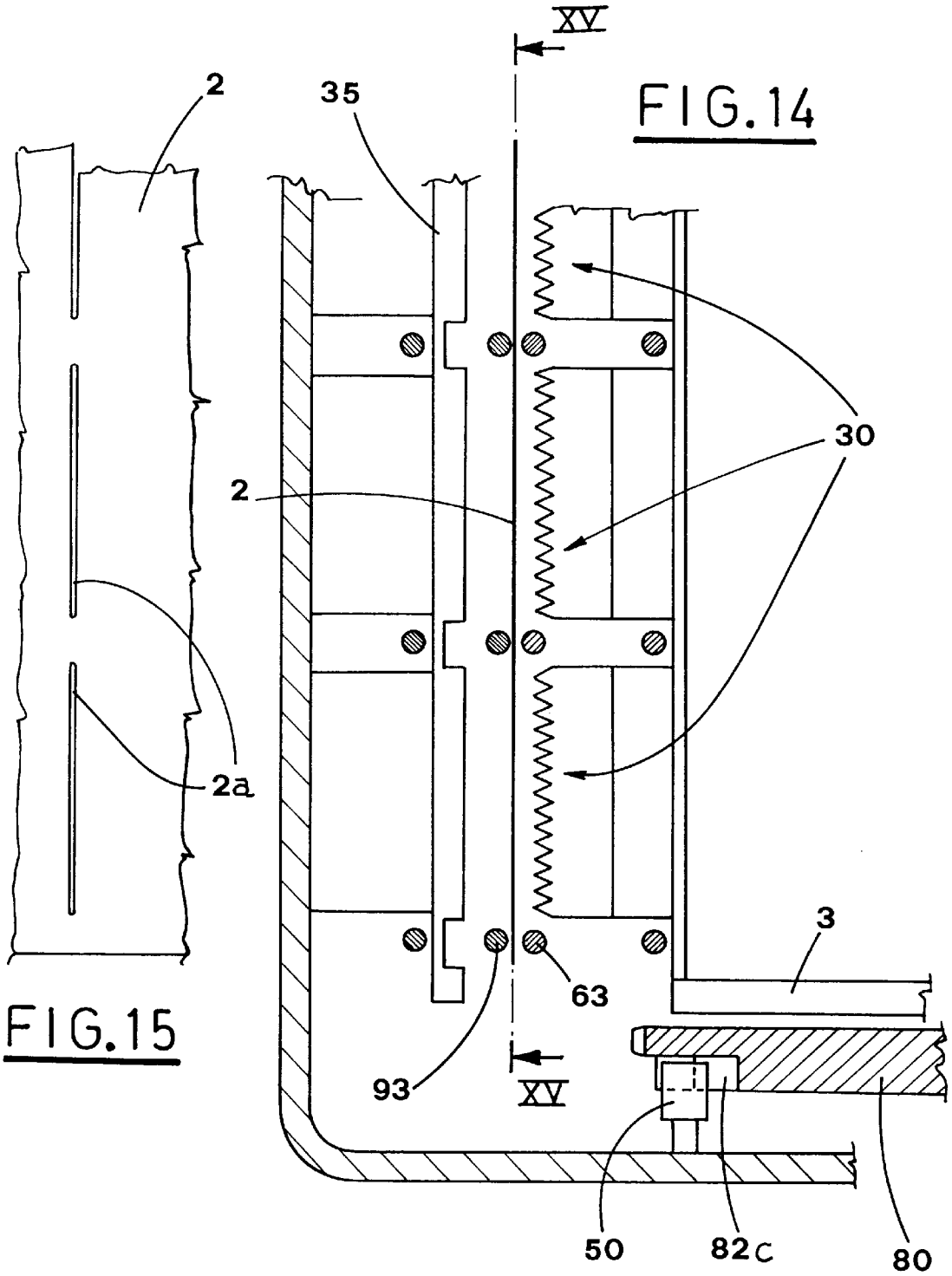
FIG. 14 shows an enlarged cross-sectional view taken along line XIV—XIV of FIG. 10.
FIG. 15 shows a fragmentary view taken along plane XV—XV of FIG. 14.

The belts 63,93 are also pushed by the member 35 and get curved while being inserted into the spaces left among the sectors of the blade 30, so that they do not touch it (see FIG. 14).

In this way, the paper 2 is partially cut and appears like in FIG. 15, i.e. broken by a series of cuts 2*a* which correspond to the sectors of the blade 30. The disc 80 continues its rotation and brings the pin 50 towards the outlet of the second portion 82*b* of the cam groove 82 running a second section with a progressively increasing radius, which causes the cover 5 go back to its closing and inoperative position R, like the one shown in FIG. 10.

As a consequence, the power driving means 7 and the disc 80 stop, and the upper rollers 61,91 get in touch with each other again.

Figure 13:
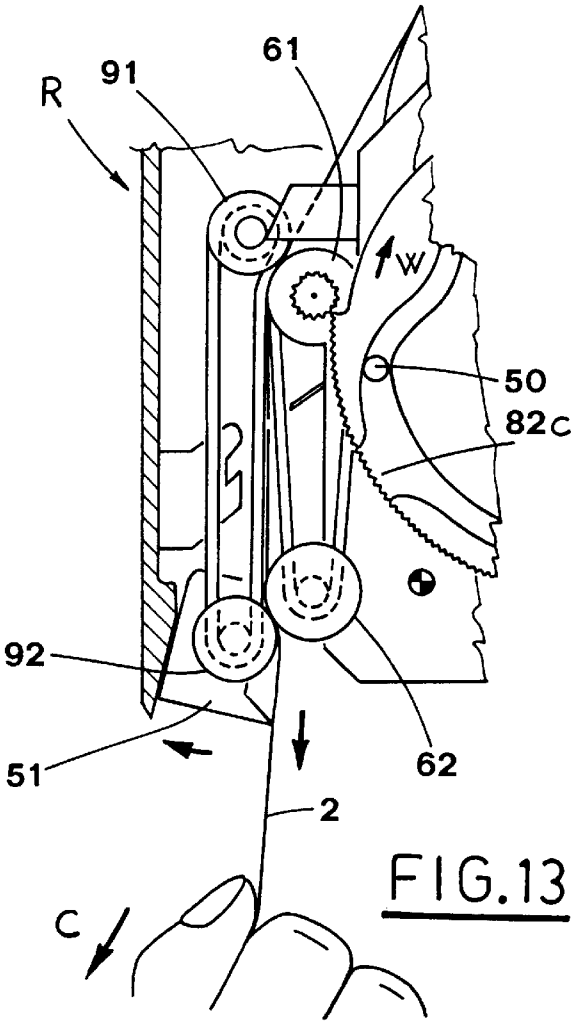

The piece of paper goes out of the dispenser 1 and is gripped by the user's hand that, like for the previously described embodiments, pulls it diagonally (in direction indicated by the arrow C in FIG. 13) so that the lever 51 swings pushing the micro switch 70. The power driving means 7 are operated again and the disc 80 rotates. The toothed sector gets in mesh with the pinion 64 setting the pulling-out mechanisms 6,9 in operation.

Since both the upper rollers 61,91 and the lower rollers 62,92 respectively touch each other, the paper is so stretched that it tears along the weakened section of the cuts 2*a* previously made by the blade 30. When the piece of paper is completely out of the dispenser the mechanisms 6,9 are stopped according to the modes already described hereinbefore.

The disc 80, that has made a complete turn, is again in its start position, as shown in FIG. 10.

In another embodiment, not shown in the figures, the dispenser 1, in all modified forms, that is for reels with pre-cut lines and for reels without such lines, is equipped with a timer instead of the rocking lever 51, that is made stationary.

The above mentioned timer is reset at the time when the pressure on the cover 5 is removed, i.e. after the piece of paper of desired length has been unrolled from the reel 2.

The timer activates the power driving means 7 for a predetermined time, long enough for carrying out the second working step, in which the piece of paper is separated and delivered.

The above description makes evident the advantages of the subject dispenser, that allows to withdraw a desired quantity of paper in an easy and hygienically protected way, since the edge of the paper remains inside the dispenser between one paper withdrawal operation and another.

Moreover, it is to be pointed out that the constructive characteristics of the proposed solutions allow to obtain a dispenser which is compact, versatile, and made of few simple, reliable and cheap components.

The low costs takes a basic importance when the market accepts or rejects certain products mainly because of costs. For this reason, some constructive solutions used in the subject dispenser, such as the cover closing and opening systems, obtained with a particular conformation of the pulling-out group, or combining various cover functions, such as total covering, outer finishing, push button control and movement of the pulling-out mechanisms, are particularly interesting.

I claim:

1. Dispenser for supplying pieces of paper from a paper strip with transversal pre-cut lines, characterised in that it includes:

a box-shaped housing (3) with a recess (4) for receiving a reel (2) of paper;

a first pulling-out mechanism (6) supported by said box-shaped housing (3) and including a first pair of horizontal rollers (61, 62), upper and lower respectively, connected to each other by a plurality of belts (63) which run into respective first and second grooves (61*a*, 62*a*) made in said upper and lower rollers (61, 62), said first grooves having their innermost diameter bigger than an innermost diameter of said second grooves;

a cover (5) hinged to said box-shaped housing (3) for allowing, when opened, insertion of a reel (2) into said recess (4), said cover being adapted to assume one or the other of two positions, namely an inoperative closing position (R) and an operative closing position (O);

a second pulling mechanism (9) supported by said cover (5) and including a second pair of horizontal rollers (91, 92) upper and lower respectively, connected to each other by a plurality of belts (93) which run into respective first and second grooves (91*a*, 92*a*), with said first grooves (91*a*) having their innermost diameter bigger than the innermost diameter of said second grooves (92*a*), with a run of each one of these last mentioned belts (93) facing a corresponding run of a respective belt (63) of said first pulling-out mechanism (6);

power driving means (7), activated by control means and provided for operating said pulling-out mechanisms (6,9) in a first situation corresponding to said closing and operative position (O) of the cover, in which the upper rollers (61,91) are almost in contact which each other, whereas the lower rollers (62,92) are separated from each other to define a condition in which a piece of paper is unrolled from the reel (2) and made pass through said upper rollers (61,91), said facing runs of the belts (63,93), and said lower rollers (62,92) then going out of said dispenser (1) downstream of said lower rollers (62,92), as well as in a second situation corresponding to said inoperative position (R) of the cover, in which said upper rollers (61,91) and respectively said lower rollers (62,92) are almost in contact with each other to define a condition in which said piece of paper is separated from said strip along one of said pre-cut lines located between said upper rollers (61,91) and lower rollers (62,92) as a consequence of pulling action due to higher speed of said lower rollers (62,92) with respect to said upper rollers (61,91).

2. Dispenser, according to claim 1, characterised in that the said control means include:

push button means (70);

a rocking lever (51), supported by the cover (5), that acts on said push button means in said first situation as a consequence of the cover passage from the inoperative position (R) to the operative position (O), and in said second situation because a piece of paper is pulled out of the dispenser.

3. Dispenser, according to claim 1, characterised in that said control means include:

push button means (70);

a rocking lever (51), supported by the cover (5) and acting on said push button means in said first situation as a consequence of the cover passage from the inoperative position (R) to the operative position (O);

a timer, reset after the first situation has been completed, simultaneously with the cover return to the inoperative position (R), for activating said power driving means (7) for a period of time corresponding to duration of said second situation.

4. Dispenser, according to claim 1, characterised in that said upper rollers (91,62) and lower rollers (92,62) and the fulcrum (F) between the cover (5) and the housing (3) are mutually positioned in such a manner that, during closing of said cover, the upper roller (91) and the lower roller (92) of the second pulling-out mechanism (9) overlap and press the upper roller (61) and the lower roller (62) of the first pulling-out mechanism (6) respectively, in order to take a stationary locking position, defining said closing inoperative position (R) of the same cover (5).

5. Dispenser for supplying pieces of paper from a paper strip, characterised in that it includes:

a box-shaped housing (3) with a recess (4) for receiving a reel (2) of paper;

a first pulling-out mechanism (6) supported by said box-shaped housing (3) and including a first pair of horizontal rollers (61,62), upper and lower respectively, connected to each other by a plurality of belts (63) which run into respective first and second grooves (61*a*, 62*a*) made in said upper and lower rollers (61,62), said first grooves having their innermost diameter bigger than an innermost diameter of said second grooves;

a switch, subjected to related elastic means (32), placed between facing runs of said belts (63) and set in engagement therewith;

a cover (5) hinged to said box-shaped housing (3) for allowing, when opened, insertion of a reel (2) into said recess (4), said cover being adapted to assume one or the other of two positions, namely an inoperative closing position (R) and an operative closing position (O);

a second pulling mechanism (9) supported by said cover (5) and including a second pair of horizontal rollers (91,92) upper and lower respectively, connected to each other by a plurality of belts (93) which run into respective first and second grooves (91*a*, 92*a*), said first grooves (91*a*) having their innermost diameter bigger than an innermost diameter of said second grooves (92*a*), with a run of each one of these last mentioned belts (93) facing a corresponding run of a respective belt (63) of the first pulling-out mechanism (6) and pressed thereonto, at least in the region of the upper part of said facing runs, by reaction of elastic means (32), connected with said switch, and by elastic reaction of said belts (93) of said second mechanism (9);

a stationary blade (30) located in a position intermediate between said upper rollers (61,91) and lower rollers (62,92);

power driving means (7), activated by control means and provided for operating said pulling-out mechanisms (6,9) in a first situation corresponding to said closing operative position (O) of the cover, in which the upper rollers (61,91) are almost in contact with each other, whereas the lower rollers (62,92) are separated from each other to define a first condition in which a piece of paper is unrolled from the reel (2) and made pass through said upper rollers (61,91), said facing runs of said belts following a path that does not interfere with said blade, and finally between said lower rollers (62, 92) then going out of the dispenser (1) downstream of said lower rollers (62,92), as well as in a second situation, corresponding to said inoperative position (R) of the cover, in which said upper rollers (61,91) and lower rollers (62,92) respectively are almost in contact with each other in order to define a second condition, in which a pulling action provoked by higher speed of said lower rollers (62,92) with respect to said upper rollers (61,91) tightens the piece of paper situated between said lower and upper rollers, and passing between said facing runs, thus changing the arrangement of said facing runs, against elastic reaction of said elastic means (32) connected to said switch, so that said piece of paper is cut by the stationary blade (30) and separated from said strip of paper.

6. Dispenser, according to claim 5, characterised in that said switch (31) includes a fork (31), that swings with respect to a fulcrum coaxial with rotation axis of the upper roller (61) of the first pulling-out mechanism (6), and that is equipped with rollers (33) supported idle on the ends of related prongs and engaged with said belts (63), with said fork (31) subjected to the action of said, elastic means (32).

7. Dispenser, according to claim 5, characterised in that it includes a tightener acting on said belts of said pulling-out mechanism (9), said tightener including a pair of rollers (41), engaged with the belts (93) and rotatably supported by bars (42) which are inserted telescopically in opposite extremities of a sleeve (43), against the action of elastic means (44).

8. Dispenser, according to claim 5, characterised in that the said control means include:

push button means (70);

a rocking lever (51), supported by the cover (5), that acts on said push button means in said first situation as a consequence of the cover passage from the inoperative position (R) to the operative position (O), and in said second situation because a piece of paper is pulled out of the dispenser.

9. Dispenser, according to claim 5, characterised in that said control means include:

push button means (70);

a rocking lever (51), supported by the cover (5), and acting on said push button means in said first situation as a consequence of the cover passage from the inoperative position (R) to the operative position (O);

a timer, reset after the first situation has been completed, simultaneously with the cover return to the inoperative position (R), for activating said power driving means (7) for a period of time corresponding to duration of said second situation.

10. Dispenser, according to claim 5, characterised in that said upper rollers (91,62) and lower rollers (92,62) ans the fulcrum (F) between the cover (5) and the housing (3) are mutually positioned in such a manner that, during closing of said cover, the upper roller (91) and the lower roller (92) of the second pulling-out mechanism (9) overlap and press the upper roller (61) and the lower roller (62) of the first pulling-out mechanism (6) respectively, in order to take a stationary locking position, defining said closing inoperative position (R) of the same cover (5).

11. Dispenser for supplying pieces of paper from a paper strip, characterised in that it includes:

a box-shaped housing (3) with a recess (4) for receiving a reel (2) of paper;

a first pulling-out mechanism (6) supported by said box-shaped housing (3) and including a first pair of horizontal rollers (61,62), upper and lower respectively, connected to each other by a plurality of belts (63) which run into respective first and second grooves (61*a*, 62*a*) made in said upper and lower rollers (61,62), said first grooves having their innermost diameter bigger than an innermost diameter of said second grooves;

a cover (5) hinged to said box-shaped housing (3) for allowing, when opened, insertion of a reel (2) into said recess (4), said cover being adapted to assume one or another of three positions, namely an inoperative closing position (R), an operative closing position (O) and a cutting position (T);

a second pulling mechanism (9) supported by said cover (5) and including a second pair of horizontal rollers (91,92) upper and lower respectively, connected to each other by a plurality of belts (93) which run into respective first and second grooves (91*a*, 92*a*), said first grooves (91*a*) having their innermost diameter bigger than an innermost diameter of said second grooves (92*a*), with a run of each one of these last mentioned belts (93) facing a corresponding run of a respective belt (63) of the first pulling-out mechanism (6);

a pinion (64) keyed onto an head of said upper roller (61) of said first pulling-out mechanism (6) and provided for being set in mesh engagement with a toothed sector (81) made along the outline of a disc (80) rotatably supported by the housing (3);

two auxiliary rollers (95) rotatably supported by opposite ends of said upper roller (91) of said second pulling-out mechanism (9) and pressed onto sloping surfaces (96*a*), formed on extensions (96) made integral with said housing (3), by the elastic reaction of the belts (93);

an annular cam groove (82) including an in/out region (82*c*) and two adjacent portions (82*a*, 82*b*), namely a first portion (82*a*) with constant radius and a second portion (82*b*) with varying radius;

a pin (50) rotatably supported by said cover (5) and running along said cam groove (82);

a blade (30) formed by adjacent sectors and supported by said housing (3) in a region intermediate between said upper rollers (61,91) and lower rollers (62,92);

a paper pressing member (35) supported by said cover (5) in a position in which it faces said blade (30); power driving means (7), activated by control means and provided for one turn rotation of said disc (80) in a predetermined direction (W) so as to determine:

a first situation, in which the cover (5) takes said closing and operative position (O), in which the paper unrolls from said reel (2) and passes through said upper rollers (61,91), which are separated from each other, said counter-facing runs of said belts (63,93), said lower rollers (62,92) which touch each other, finally going out of said dispenser (1) downstream of said lower rollers (62,92);

a second situation, in which the cover (5) takes said cutting position (T), in which the paper unrolling stops and the paper located between said pulling-out mechanisms (6,9) is pushed by said paper pressing element (35) against said blade (30), so that a series of cuts (2*a*) are made in the paper;

a third situation, in which said cover (5) takes said inoperative position (R), in which said pulling-out mechanisms (6,9), with said upper rollers (61,91) and lower rollers (62,92) respectively touching each other, are operated to tear a piece of paper from said strip along said cuts (2*a*) as a consequence of a pulling action provoked by higher speed of said lower rollers (62,92) with respect to said upper rollers (61,91).

12. Dispenser, according to claim 11, characterised in that said second portion (82*b*) of said cam groove (82) includes a first section with decreasing radius and a second section with increasing radius, so that:

in said first situation said pin (50) runs said first portion (82*a*) of said cam groove (82) starting from said in/out region (82*c*) while said toothed sector (81) is in mesh engagement with said pinion (64), for operation of said pulling-out mechanisms (6,9), and said auxiliary rollers are in abutment onto said sloping surfaces (96*a*) to raise said upper roller (91) connected thereto and move it apart from the adjacent upper roller, (61), thus allowing the paper to slip between said upper rollers (61,91);

in said second situation said pin (50) runs said first section of said second portion (82*b*), while said toothed sector (81) is disengaged from said pinion (64) and the cover (5) moves to said cutting position (T) in which the paper is pushed by the paper presser member (35) against the blade (30) while said pulling-out mechanisms (6,9) are stopped;

in said third situation said pin (50) runs said second section of said second portion (82*b*), while said toothed sector (81) is kept in mesh with said pinion (64) thus moving said cover to said inoperative position (R) and operating said pulling-out mechanisms (6,9).

13. Dispenser, according to claim 11, characterised in that the said control means include:

push button means (70);

a rocking lever (51), supported by the cover (5), that acts on said push button means in said first situation as a consequence of the cover passage from the inoperative position (R) to the operative position (O), and in said second situation because a piece of paper is pulled out of the dispenser.

* * * * *